US006206812B1

(12) United States Patent
Nizamuddin

(10) Patent No.: US 6,206,812 B1
(45) Date of Patent: Mar. 27, 2001

(54) STRETCHING AND CONDITIONING FITNESS DEVICES

(76) Inventor: Nash Nizamuddin, 21 Derrydown Rd., Unit 3, Downsview, Ontario (CA), M3J 1R2

( * ) Notice: Subject to any disclaimer, the term of this patent is extended or adjusted under 35 U.S.C. 154(b) by 0 days.

(21) Appl. No.: 09/062,133

(22) Filed: Apr. 17, 1998

Related U.S. Application Data

(60) Provisional application No. 60/054,007, filed on Jul. 29, 1997.

(51) Int. Cl.[7] ..... A63B 21/00

(52) U.S. Cl. ..... 482/131; 482/49; 482/80; 482/122; 482/125; 482/126; 482/129; 482/148; 482/908

(58) Field of Search ..... 482/142, 121, 482/123, 126, 129, 130, 131, 124, 125, 127, 49, 72, 80–82, 95, 101, 120, 122, 907, 148

(56) References Cited

U.S. PATENT DOCUMENTS

| | | | | |
|---|---|---|---|---|
| 4,743,010 | * | 5/1988 | Geraci | 272/72 |
| 4,988,096 | * | 1/1991 | Jones | 272/118 |
| 5,007,632 | * | 4/1991 | Wilkinson | 272/72 |
| 5,421,795 | * | 6/1995 | Chen | 482/96 |
| 5,645,514 | * | 7/1997 | Chen | 482/72 |

* cited by examiner

*Primary Examiner*—Jerome W. Donnelly
*Assistant Examiner*—Lori Baker Amerson
(74) *Attorney, Agent, or Firm*—Riches, McKenzie & Herbert

(57) ABSTRACT

The present invention discloses a fitness device which includes a seat, a telescoping means which is attached to the seat at a terminal portion thereof by a pivot means and a support means which is attached to a second terminal portion of the telescoping means. The fitness device is adapted to support the hands and feet of a user who desires to stretch, strengthen and condition various muscle groups in the user's body.

23 Claims, 6 Drawing Sheets

FIG. 7.
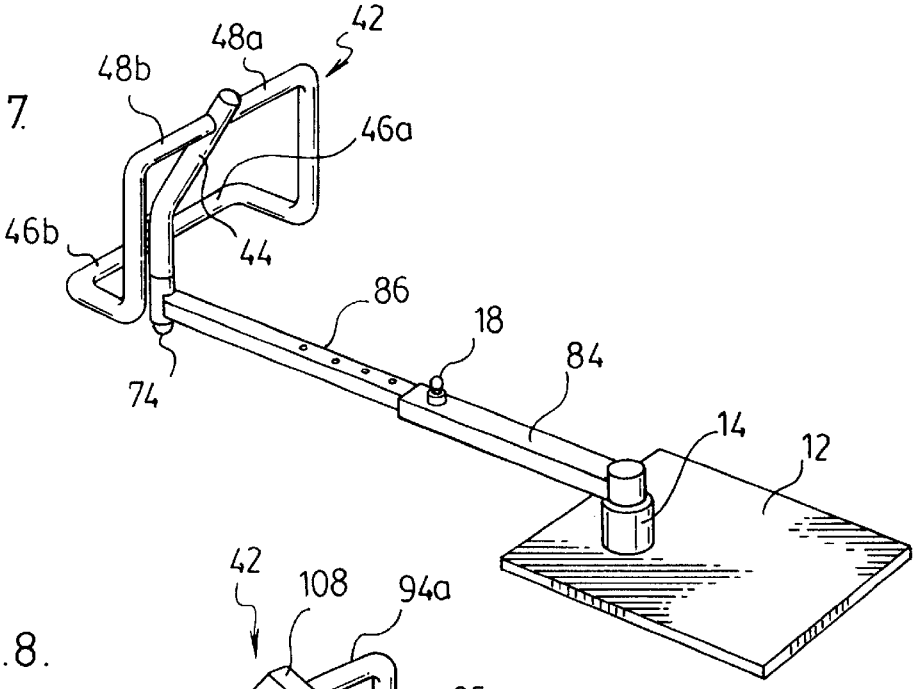
FIG. 8.
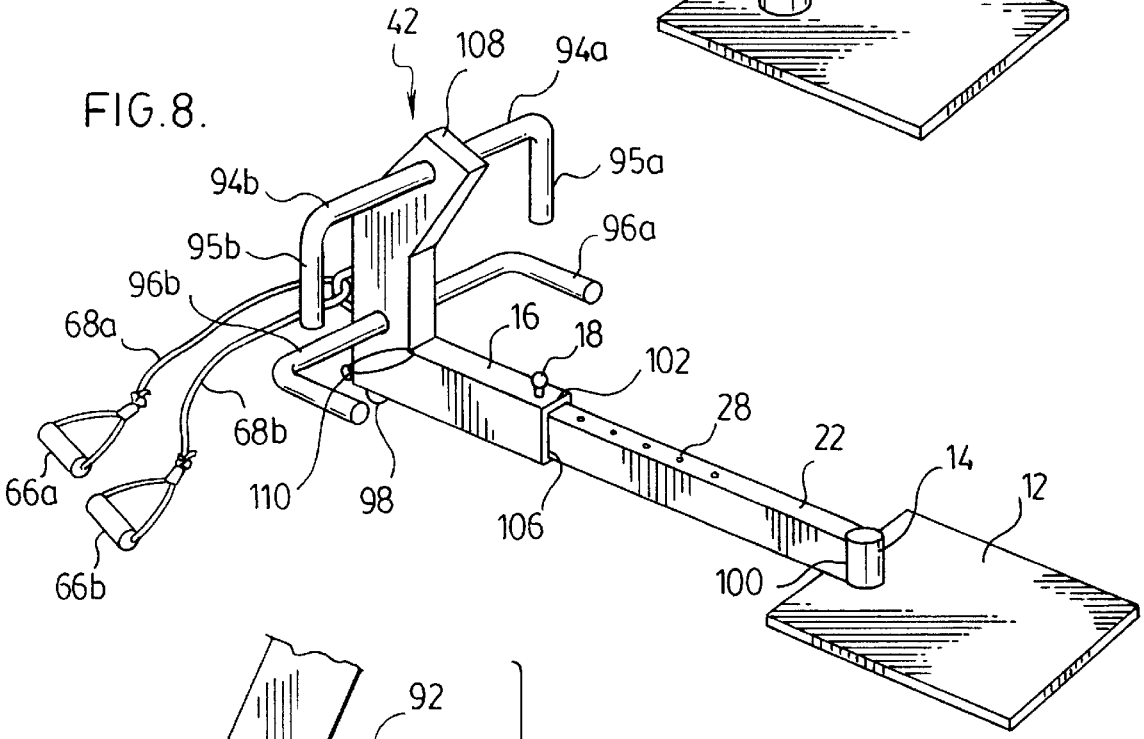
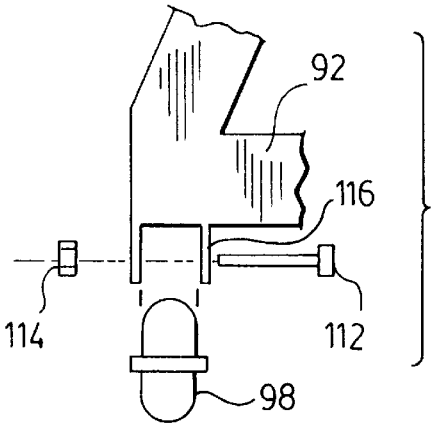
FIG. 9.

STRETCHING AND CONDITIONING FITNESS DEVICES

This application claims priority based on provisional application Serial No. 60/054,007 filed on Jul. 29, 1997 by the inventor.

BACKGROUND OF THE INVENTION

1. Field of the Invention

The present invention relates to fitness devices that can be used for stretching, physical therapy, and for strengthening and toning exercises. More specifically, the present invention relates to an improved fitness device which allows a user to perform, in either a sitting or lying position, a variety of stretching and conditioning exercises that utilize many of the major muscle groups of the body.

2. Description of the Prior Art

It is extremely beneficial to be able to achieve flexibility and conditioning during or prior to exercise routines or for cooling down purposes. Accomplishing full body stretching in an easy, effective and enjoyable manner is desirable.

Many prior art fitness devices designed to facilitate the performance of stretching exercises focus generally on stretching the leg muscles. Other stretching machines that provide exercises in addition to leg stretching are often limited to providing a small range of stretching and conditioning exercises.

A need exists for a compact, quiet device with minimal moving parts which allows performance of a broad range of exercises which target the arm, back, shoulder, abdominal and leg muscles.

SUMMARY OF THE INVENTION

The objectives of the present invention are accomplished by providing a fitness device that allows a user to perform a broad range of exercises that target muscles in the arms legs, back abdominal and shoulders. The fitness device of the present invention includes a seat, a telescoping means and a support means. The telescoping means is attached to the seat at a terminal portion thereof by a pivot means and the support means is attached to a second terminal portion of the telescoping means adapted to support the hands and feet of a user.

BRIEF DESCRIPTION OF THE DRAWINGS

FIG. 7 is a perspective view of another embodiment of the present invention.

FIG. 8 is a perspective view of yet another embodiment of the present invention.

FIG. 9 is an exploded view of the underside of the wheels of the present invention.

DETAILED DESCRIPTION OF THE INVENTION

Figure 1:
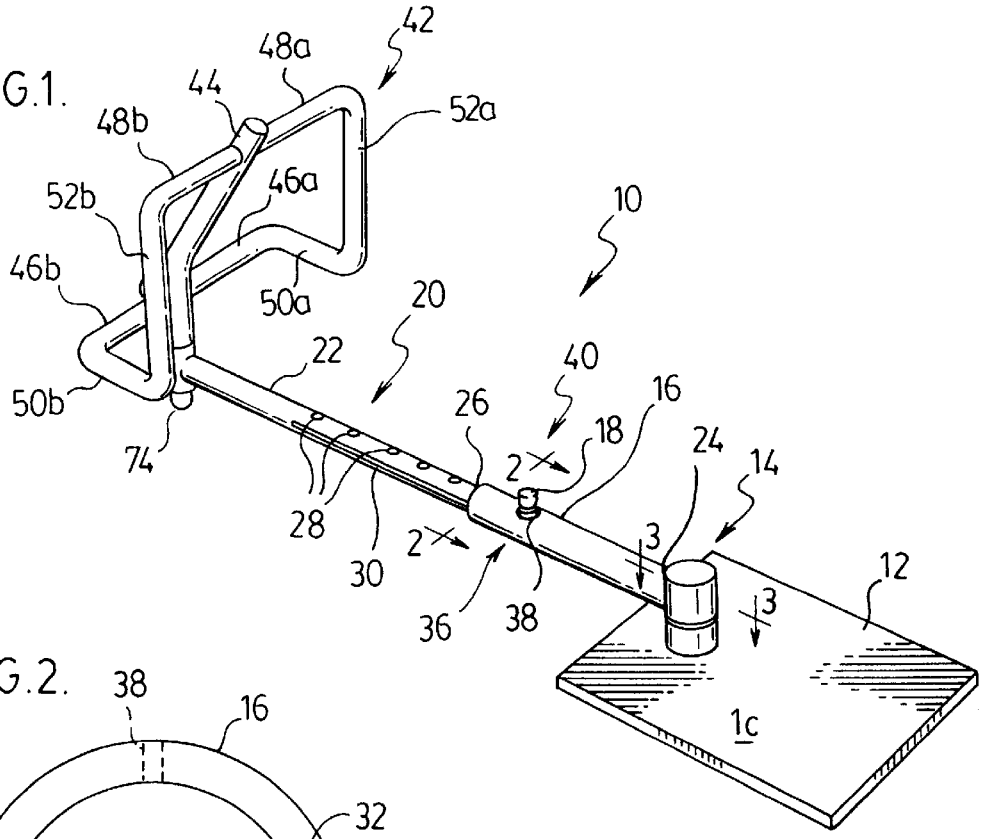
FIG. 1 is a perspective view of an embodiment of the present invention.

The various aspects of the present invention are shown in the three embodiments of fitness device 10 disclosed in this application. FIGS. 1 through 8 show an embodiment of fitness device 10 and FIGS. 9 and 10 indicate two other embodiments of the present invention. Where common parts appear in the various embodiments, similar reference characters are used in each embodiment.

Referring to FIG. 1, a perspective view of an embodiment of the present invention, seat 12 is preferably a rigid frame constructed from plastic, wood, or metal. Seat 12 can also be the surface of a floor. Seat 12 is connected to telescoping means 20 by pivot means 14. Telescoping means 20 includes outer tube 16 and inner tube 22.

Inner tube 22 includes a plurality of apertures 28 and at least one guide slot 30. Inner circumference 32 of outer tube 16 contains at least one groove 34 and at least one port 38. Groove 34 is adapted to allow the slots 30 on inner tube 22 to slide into position inside the outer tube 16 and port 38 is adapted to allow pin 18 to fit within it. First terminal portion 24 of outer tube 16 is connected to pivot means 14. Inner tube 22 telescopically resides within outer tube 16 entering at second terminal portion 26 of outer tube 16.

Figure 2:
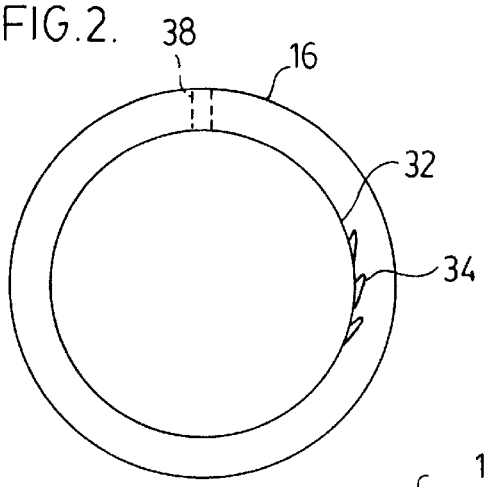
FIG. 2 is cross-sectional view taken along lines 2—2 of FIG. 1.

Alignment means 36 is preferably provided for the proper positioning of outer tube 16 and inner tube 22 with relationship to each other. A cross-section section of outer tube 16 is shown in FIG. 2. Alignment means 36 may include grooves 34 in the inner circumference 32 of outer tube 16 and guide slot 30 in the outer portion of outer tube 16.

Securing means 40 for temporarily securing and positioning inner tube 22 with relationship to outer tube 16 can be provided by a variety of means well known to those skilled in the art. Preferably, inner tube 22 includes a plurality of apertures 28 and outer tube 16 is provided with pin 18 and port 38 such that inner tube 22 may be positioned within outer tube 16 with the alignment of apertures 28 with port 38. This alignment can then be secured by insertion of pin 18 through port 38 extending into inner tube 22 through apertures 28. Pin 18 can be any suitable mechanism that allows inner tube 22 to be locked into position inside outer tube 16 by means of inserting pin 18 into a chosen aperture 28. Preferably, pin 18 forms a spring type device that is easily moved by pulling upwards to dislodge and then releasing to lock into position with a chosen aperture.

Inner tube 22 which telescopically resides within outer tube 16 can be longitudinally adjusted by, for example, slidably removing pin 18 through port 38 to align a chosen aperture with port 38 and releasing pin 18 through port 38 into aperture 28 to achieve a desired length.

Support means 42 includes attachment means 44 which is connected to inner tube 22 at a terminal portion thereof in a substantially non-horizontally manner, i.e. preferably from less than about 75 degrees, more preferably about 45 degrees from the vertical. Extending from attachment means 44 proximate inner tube 22, distant outer tube 16 are primary foot rests 46*a* and 46*b*. Extending from attachment means 44, proximate the terminal portion of support means 42, distant primary foot rests 46*a* and 46*b* extend primary hand grips 48*a* and 48*b*. Primary foot rests 46*a* and 46*b* and primary hand grips 48*a* and 48*b* extend substantially perpendicular to the longitudinal axis of inner tube 22.

In this embodiment, support means 42 further includes side foot rests 50*a* and 50*b* which extend from the portion of primary foot rests 46*a* and 46*b* focused substantially towards seat 12. Auxiliary hand grips 52*a* and 52*b* are attached to terminal portions of primary hand grips 48*a* and 48*b* and extend towards inner tube 22 as shown in FIG. 1. Also as show in FIG. 1 auxiliary hand grips 52*a* and 52*b* are preferably connected to side foot rest 50*a* and 50*b*.

Figure 3:
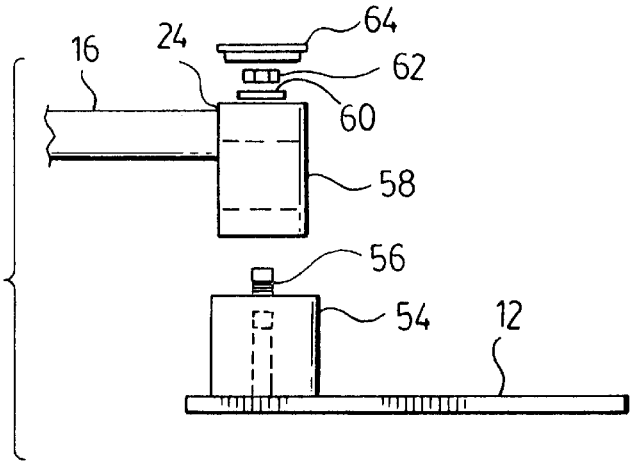
FIG. 3 is a an exploded view of the pivot means of the present invention.

As shown in FIG. 3 pivot means 14 of the present invention includes inner housing 54 attached to seat 12 by means of first bolt 56. First bolt 56 extends beyond the end portion of inner housing 54 distant the attachment area of inner housing to seat 12. Outer housing 58 adapted to circumferencially surround inner housing 54 such that first bolt 56 resides within outer cylinder 58 As stated with regards to FIG. 1, pivot means 14 is connected to outer tube 16 at a first terminal portion. This assembly of outer tube 16 and outer housing 58 are secured to seat 12 through first bolt 56. First bolt 56 is attached by means of washer 60 and nut 62. The portion of outer housing 58 distant seat 12 can be enclosed by means of cap 64 which is useful to cover nut 62 and also for aesthetic purposes.

Figure 4:
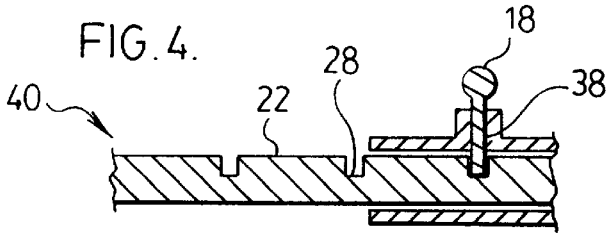
FIG. 4 is a cross-sectional view taken along lines 3—3 of FIG. 1

FIG. 4 illustrates a cross-sectional view of the securing means 40. Securing means 40 is more clearly depicted with outer tube 16, inner tube 22, apertures 28 port 38 and pin 18.

Figure 5:
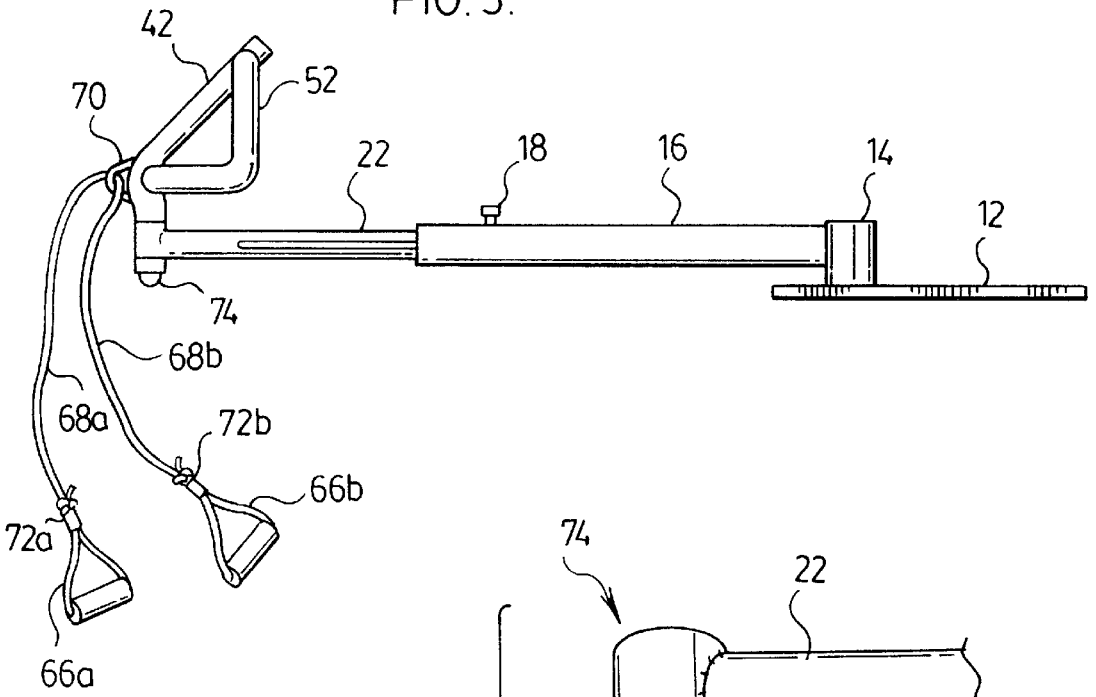
FIG. 5 is a side view of an embodiment of the present invention with elongated elastic means.

The embodiment shown in FIG. 5 includes elongate elastic means 68*a* and 68*b*. Elongate elastic means 68 preferably have alternative hand grips similar to those shown in embodiment illustrated in FIG. 1. The elements in this embodiment that are similar to those in other embodiments are indicated with the same numbers as shown in the other embodiments. The alternative hand grips 66*a* and 66*b* are attached to support means 42. Elongate elastic means 68 travels through holding means 70 which is outboard to support means 42. Preferably the terminal portion of elongate elastic means 68 are attached to hand grips 66*a* and 66*b* by means of hooks 72*a* and 72*b*.

Figure 6:
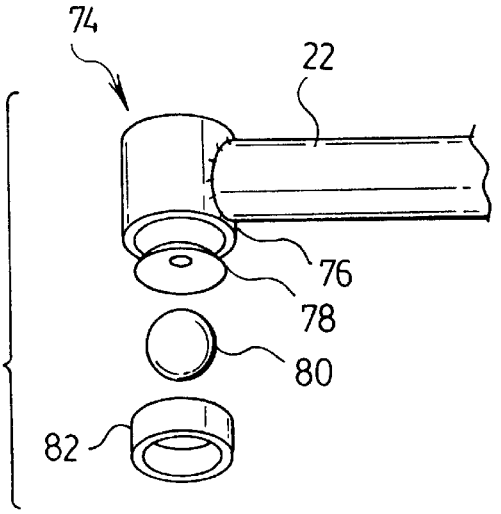
FIG. 6 is an exploded view of the underside of the rolling means of the present invention.

As shown in FIGS. 5 & 6, fitness device 10, is preferably provided with rolling means 74 which is well known to those skilled in the art. Rolling means 74 are located on the underside of inner tube 22, proximate support means 42, distant seat 12. Rolling means 74 includes base portion 76 which is attached to the lower portion of inner tube 22 with inwardly concave member 78 extending from base 76 to receive end cap 82. End cap 82 is preferably attached to base 76 by press-fit or threading means. Rotating member 80 abuts concave member 78 and extends through an opening in end cap 82 such that the end portion of the fitness device 10 distant the seat means 12 is permitted to roll on the surface on which the device is placed.

FIG. 7 shows another embodiment of the present invention. The embodiment shown in FIG. 7 is similar to the embodiment shown in FIG. 1 with several similar elements. Therefore, like elements have been indicated with the same numbers on both Figures. The embodiment illustrated in FIG. 7 differs from the embodiment shown in FIG. 1 from the stand point that the telescoping means 20 includes a four sided inner tube 22 and a four sided outer tube 16. Further, the embodiment of FIG. 7 does not utilize alignment means 36, but only uses securing means 40.

FIG. 8 illustrates yet another embodiment of the present invention. To those skilled in the art it is evident that either an outer tube or an inner tube can be connected to seat 12. It is also know to those in the art that the shape of the material from which the outer and inner tubing is formed can be circular, or angular. The embodiment shown in FIG. 8 preferably has inner tube 22 attached to seat 12 by pivot means 14 at a first end 100 and outer tube 16 attached to attachment means 42 at a second end position 102 The shape of the outer tube 16 and inner tube 22 are also preferably four sided.

Outer tube 16 includes a pin 18, apertures 28 and port 38. Securing means 40 for temporarily securing and positioning inner tube 16 with relationship to outer tube 22 can be provided by a number of means well know in the art. Preferably, inner tube 16 includes a plurality of apertures 28 and outer tube 22 is provided with port 38 such that inner tube 16 can be positioned within outer tube 22 with the alignment of an apertures 28 with port 38 and secured by insertion of pin 18 through port 38 extending into inner tube 16 through apertures 28. With inner tube 16 telescoping with outer tube 22, telescoping means 20 can be adjusted to a desired length by slidably removing and inserting pin 18 through port 38 with a chosen aperture 28.

It is well know in the art that outer tube 16 can be made up of two or three parts that are connected together to form support means 104. Preferably, support means 42 is a continuous member having a proximate end 106, a distal end 108 and a middle section 110. Support means 42 extends in a substantially horizontal manner, orienting in an angular position substantially upwards at an angle from about 60° to about 90° from the substantially horizontal portion of outer tube 16 and bending forward focused in the direction of seat 12.

Extending outwardly on either side of outer tube 16 away from the distal end 108 of outer tube 16 are a pair of primary hand grips 94*a* and 94*b*. It is well know in the art that hand grips 94*a* & 94*b* can be any shape or length that would allow a user to comfortably grasp and hold on to when exercising. Preferably hand grips 94*a* and 94*b* extend out from outer tube 16 in a substantially horizontal manner and then extending downward to form auxiliary hand grips 95*a* and 95*b*.

Primary foot rests 96*a* and 96*b* can be any shape or length that allows a user to comfortably rest his/her feet during exercising. Foot rest 96*a* and 96*b* preferably extend out from outer tube 16 at about the middle section 110 in a substantially horizontal manner then extends focused in the direction of seat 12 to form side foot rest 97*a* and 97*b*. The embodiment of FIG. 8 may also have alternative hand grips 66*a* and 66*b* attached to support means 42 by elongate elastic means 68 similar to the embodiment described in FIG. 5.

FIG. 9 illustrates an exploded view of wheel 98 of FIG. 8. Wheel 98 is attached to the underside of outer tube 16 at about the middle section 110. Wheel 98 is preferably attached to second base 116 by press-fit or threading means. Those skilled in the art are well aware that any means that causes the embodiment of FIG. 8 to move or glide freely over the surface on which the device is placed can be used in this invention.

Figure 10:
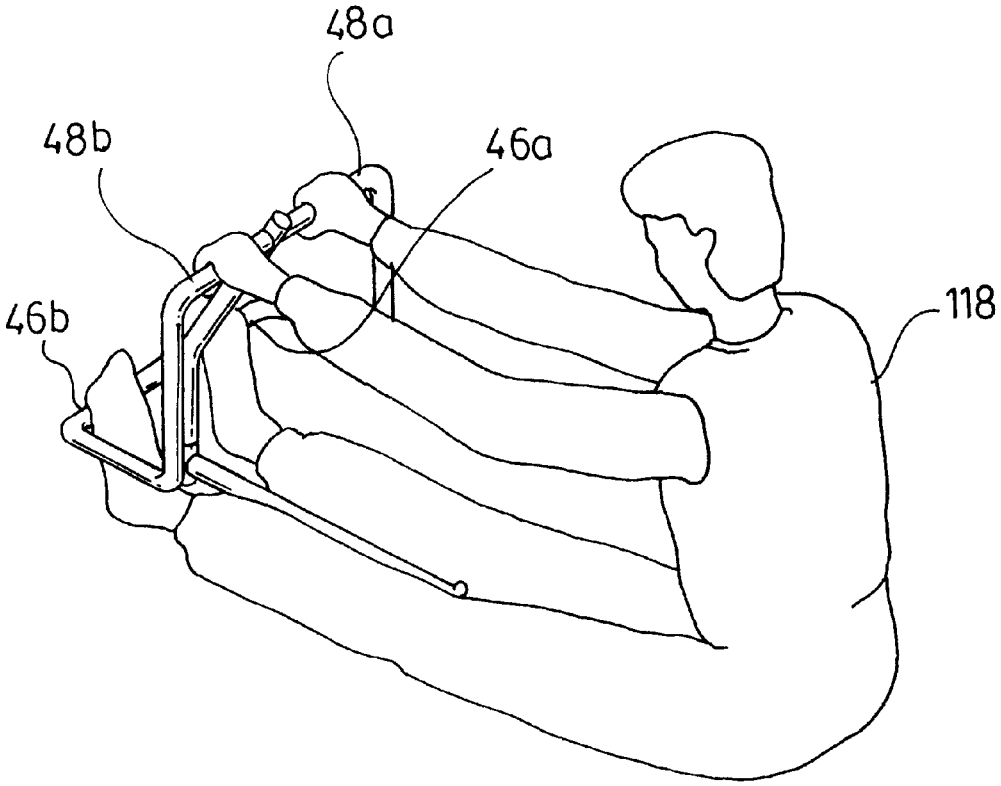
FIG. 10 illustrates a user in one possible stretching position that can be achieved by using the present invention.

When in use, the fitness device 10 of the present invention serves a two fold purpose. It allows a user to perform stretching, exercises that affect and utilize many of the major muscles groups in the body. When the elongated elastic means 68*a* and 68*b* are used a user can also condition, strengthen and tone may of the major muscle groups in the body. Preferably the seat 12 of the present invention is placed on the floor with the weight of the user being used to secure the device on the horizontal surface, namely the floor. FIG. 10 shows a user 118 in a stretching position with his hands on primary hand grips 48*a* and 48*b* and feet pushing against primary foot rest 46*a* and 46*b*. In this position a user by pulling himself forward to the point where he is experiencing mild tension, and holding this position the user is performing a stretching function in his calf, ham strings and lower back.

Figure 11:
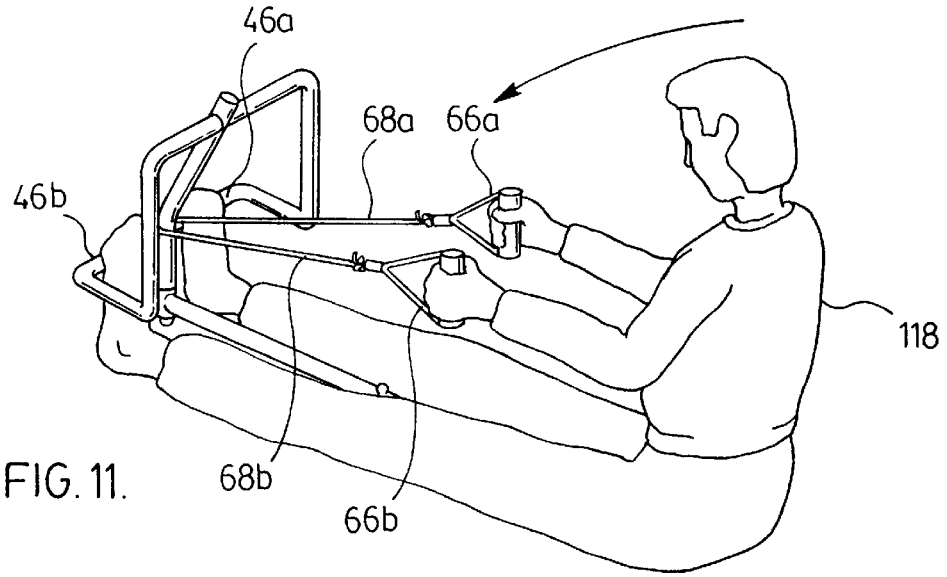
FIG. 11 illustrates a user in another possible stretching and conditioning position that can be achieved by using the present invention.
Figure 12:
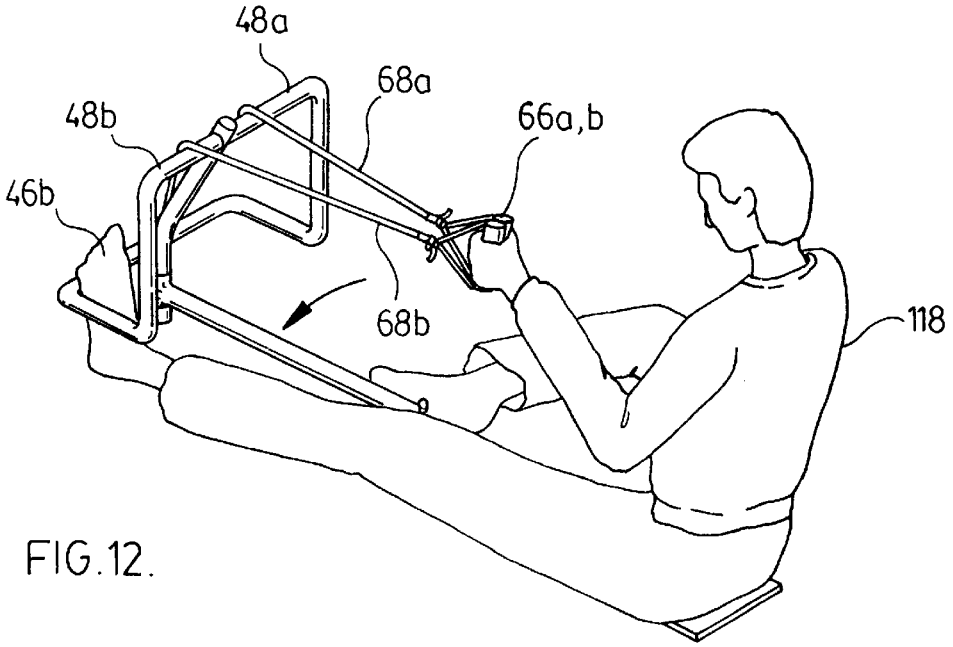
FIG. 12 illustrates a user in yet another possible stretching and conditioning position that can be achieved by using the present invention.

FIG. 11 illustrates a user with his feet on primary foot rest 46*a* and 46*b* and his hands grasping and pulling on alternative hand grips 66*a* and 66*b*. In this position a user is able to tone strengthen and condition the muscles in the arms shoulder and back. The present invention allows user 118 to stretch out his or her muscles and then using elongated elastic means 68*a* & 68*b* strengthen, condition and tone the same muscles that were stretched. The user can control the level of resistance required by either shortening elastic means 68*a* & 68*b* or using the full length provided. As shown in FIG. 12, user 118 is achieving a greater level of resistance by wrapping elastic means 68*a* and 68*b* around primary hand grips 48*a* & 48*b*.

User 118 in FIG. 12 is shown with his left foot on primary foot rest 46*b* and his right foot positioned on telescoping means 20. User 118 is stretching his calf, hamstring and lower back muscles and conditioning and toning them as he stretches elongated elastic means 68*a* and 68*b* holding onto alternative hand grips 66*a* and 66*b*. To provide more resistance in stretching, toning strengthening toning the following muscles, elongated elastic means 68*a* and 68*b* are looped over primary hand grips 48*a* and 48*b*.

Figure 13:
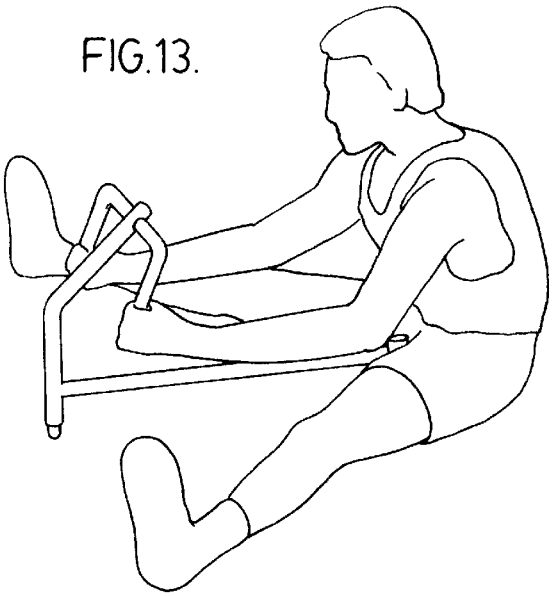
FIG. 13 illustrates a user in another stretching position.

FIG. 13 illustrates user 118 in a stretching position. His legs are spread apart to allow him to roll fitness device 10 from one leg to the other at the same time, pulling forward to stretch muscles in the groin and inner thighs.

Figure 14:
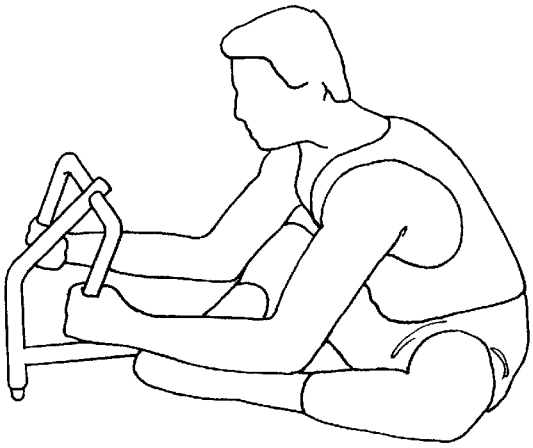
FIG. 14 illustrates a user in still another stretching position.

FIG. 14 illustrates user 118 with his legs pulled up against his body as he leans over and grasps the primary hand grips 48*a* and 48*b*. In this position, the user is benefiting from stretching muscles at the back of his lower body such as hamstrings, soleus, gastrocnemius and gluteus maximus and in his upper body stretching his deltoids.

Figure 15:
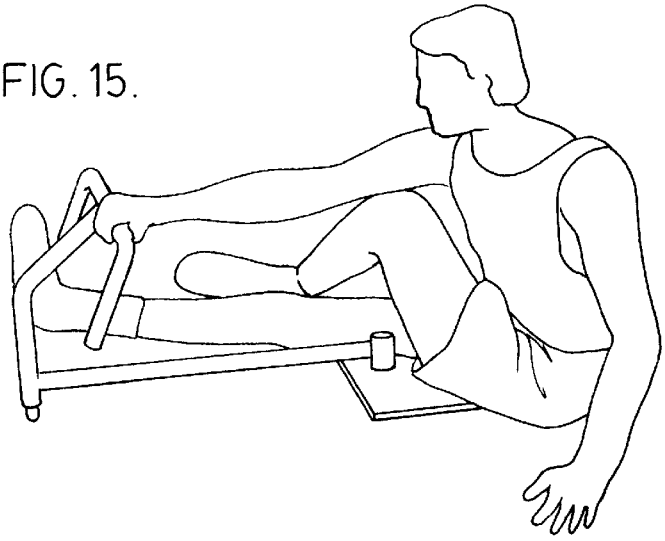
FIG. 15 illustrates a user in yet another stretching position.

The user 118 in FIG. 15 displays another stretching position that can be achieved by using the fitness device 10 of the present invention. In this position user 118 has crossed his left leg over his right leg while pulling with one hand on the primary hand grips 48*a* and 48*b*. The user 118 as shown in this position is able to achieve stretching of his deltoids in his arms and his gluteus maximus hamstrings and soleus in his lower body.

Index of elements in the Drawings

| | | | |
|---|---|---|---|
| 10 | fitness device | 70 | holding means |
| 12 | seat | 72a&b | hooks |
| 14 | pivot means | 74 | rolling means |
| 16 | outer tube | 76 | base portion |
| 18 | pin | 78 | inward concave member |
| 20 | telescoping means | 80 | rotating member |
| 22 | inner tube | 82 | end cap |
| 24 | first terminal portion | 84 | |

-continued

Index of elements in the Drawings

| | | | |
|---|---|---|---|
| 26 | second terminal portion | 86 | |
| 28 | plurality of apertures | 88 | inner section of section outer tube |
| 30 | guide slot | 90 | |
| 32 | inner circumference | 92 | |
| 34 | groove | 94a & b | primary hand grips |
| 36 | alignment means | 95a & b | auxiliary hand grips |
| 38 | port | 96a & b | primary foot rests |
| 40 | securing means | 97a & b | side foot rests |
| 42 | support means | 98 | wheels |
| 44 | attachment means | 100 | first end |
| 46a & b | primary foot rest | 102 | second end |
| 48a & b | primary hand grips | 104 | |
| 50a & b | side foot rests | 106 | proximate end |
| 52a & b | auxiliary hand grips | 108 | distal end |
| 54 | inner housing | 110 | middle section |
| 56 | first bolt | 112 | second bolt |
| 58 | outer housing | 114 | second nut |
| 60 | washer | 116 | footing |
| 62 | first nut | 118 | user |
| 64 | cap | 120 | |
| 66a & b | alternative hand grips | 122 | |
| 68a & b | elongated elastic means | 124 | |

I claim:

1. A fitness device comprising:

(a) a seat;

(b) an elongated telescoping means extending from a first terminal portion to a second terminal portion, the telescoping means attached to said seat at said first terminal portion thereof by a pivot, wherein said second terminal portion of said telescoping member is pivotally movable about said pivot relative to said seat; and (c) a support attached to said second terminal portion of said telescoping means distant said seat for pivotal movement with the telescoping means about said pivot, said support for supporting the hands and feet of a user.

2. The fitness device of claim 1 further comprising elongated elastic means.

3. The fitness device of claim 2 wherein the device includes hand grips which are attached to said elastic means by a pair of hooks.

4. The fitness device of claim 2 wherein the device includes a holding means for said elongated elastic means, said holding means being coupled to an outboard portion of the support means remote from the seat.

5. The fitness device of claim 1 wherein the seat forms a rigid frame, said frame is constructed from materials selected from the group consisting of, wood, plastic and metal.

6. The fitness device of claim 1 wherein the telescoping means includes an outer tube and an inner tube, said inner tube selectively telescopically movable within said outer tube.

7. The fitness device of claim 6 wherein the inner tube includes a plurality of apertures and at least one guide slot.

8. The fitness device of claim 6 wherein the outer tube comprises an inner circumference, said inner circumference includes at least one Groove and at least one port, such that the inner tube may be positioned within the outer tube by aligning an aperture with said port, the alignment of said aperture with said port being achieved by the insertion of a pin through said port extending into said inner tube through said aperture.

9. The fitness device of claim 1 wherein the support means includes an attachment means, said attachment means is connected to said inner tube at a terminal portion thereof in a substantially non-horizontal manner.

10. The fitness device of claim 9 wherein said attachment means forms primary foot rest, proximate said inner tube and distant said outer tube.

11. The fitness device of claim 10 wherein said primary foot rests extend, focused substantially towards said seat to form side foot rests.

12. The fitness device of claim 10 wherein said support means further includes primary hand grips, said primary hand grips extend from the attachment means proximate the terminal portion of said support and distant the primary foot rests.

13. The fitness device of claim 12 wherein said primary hand grips extend to form at a terminal portion thereof, auxiliary hand grips, said auxiliary hand grips extending towards said inner tube and connected to said side foot rests.

14. The fitness device of claim 6 further comprising a rolling means.

15. The fitness device of claim 14 wherein said rolling means includes a base portion, an end cap and a rolling member, the base portion attached to the lower portion of said inner tube and forming an inwardly concave member receiving the end cap with the rotating member abutting said concave member and extending through an opening in said end cap, such that the second terminal end portion of said fitness device is permitted to roll on a surface on which the device is placed.

16. The fitness device of claim 1 wherein the telescoping means forms a rounded tube.

17. The fitness device of claim 1 wherein the telescoping means forms a four sided tube.

18. A fitness device comprising:

(a) a seat;

(b) a telescoping means, said telescoping means attached to said seat at a terminal point thereof by a pivot means; and (c) a support means attached to a second terminal portion of said telescoping means distant said seat, said support means for supporting the hands and feet of a user, wherein the telescoping means comprises an inner tube and an outer tube, said inner tube is connected to said pivot means at a first end, said pivot means forms a pivotal attachment to said seat and said outer tube forms said support means.

19. The fitness device of claim 18 wherein said support means includes a proximate end, a middle section and a distal end, extending from said distal end are hand grips.

20. The fitness device of claim 18 wherein said outer tube extends in a substantially horizontal manner and then projecting downward to form auxiliary hand grips.

21. The fitness device of claim 18 wherein said support means further includes a primary foot rest extending out from said outer tube at about the middle section in a substantially horizontal manner.

22. The fitness device of claim 21 wherein said primary foot rests extend focused in the direction of said seat to form said side foot rests.

23. A fitness device comprising:

(a) a seat;

(b) a telescoping means, said telescoping means attached to said seat at a terminal point thereof by a pivot means;

(c) a support means attached to a second terminal portion of said telescoping means distant said seat, said support means for supporting the hands and feet of a user; and (d) a rolling means, wherein said rolling means includes a base portion attached to a lower portion of said telescoping means, said base portion forms an inwardly concave member for receiving an end cap with a rotating member abutting said concave member and extending through an opening in said end cap such that the second terminal portion of said fitness device is permitted to roll on a surface of which the device is placed.

* * * * *